US005986576A

United States Patent [19]

Armstrong

[11] Patent Number: 5,986,576

[45] Date of Patent: Nov. 16, 1999

[54] REMOTE CONTROL PORTABLE TRAFFIC CONTROL DEVICE AND SYSTEM

[76] Inventor: Sheldyn Kyle Armstrong, 251 Academy Woods Dr., Gahanna, Ohio 43230

[21] Appl. No.: 09/010,298

[22] Filed: Jan. 21, 1998

[51] Int. Cl.[6] ..... H01Q 1/36

[52] U.S. Cl. ..... 340/908; 340/907; 116/63 P

[58] Field of Search ..... 340/908, 907, 340/902, 904, 539; 116/63 R, 63 P

[56] References Cited

U.S. PATENT DOCUMENTS

| | | | |
|---|---|---|---|
| 2,829,362 | 4/1958 | Terrill | 340/908 |
| 2,941,185 | 6/1960 | Mullikin | 340/908 |
| 3,778,762 | 12/1973 | Jarko et al. | 340/931 |
| 4,651,061 | 3/1987 | Spissinger | 315/200 R |
| 4,857,921 | 8/1989 | McBride et al. | 340/912 |
| 5,252,969 | 10/1993 | Kishi | 340/908 |
| 5,276,728 | 1/1994 | Pagliaroli et al. | 379/58 |
| 5,294,138 | 3/1994 | Yang | 280/47.34 |
| 5,345,232 | 9/1994 | Robertson | 340/906 |
| 5,400,019 | 3/1995 | Riscoe, Jr. | 340/908 |
| 5,493,292 | 2/1996 | Fanslow et al. | 340/908 |

*Primary Examiner*—Jeffrey A. Hofsass
*Assistant Examiner*—Ashok Mannava
*Attorney, Agent, or Firm*—Michael I. Kroll

[57] ABSTRACT

A remote control portable traffic signaling device (10) and system (94) for controlling a flow of traffic. The remote control portable traffic signaling system (94) includes the portable signaling device (10) and a plurality of warning flashers (76). The portable signaling device (10) includes a remote control unit (42) and a signal head (11) having an LED display device (50) and a microprocessor (46). The remote control unit (42) transmits a control signal to be received by the microprocessor (46) for use in controlling a message communicated by the LED display device (50). A base unit (30) including a storage compartment for housing the power source (36) is connected to the signal head (11) for supplying power to the microprocessor (46) and LED display device (50) via a connection wire (38) extending through a pole (24) positioned therebetween. A device for adjustably connecting the pole (26, 27, 28, 29, 35, 64 and 65) between the signal head (11) and base unit (30) allows for height adjustment of the portable signaling device (10). A plurality of warning flashers (76) including a pair of high luminous LEDs (82) are positioned at a predetermined distance from the portable signaling device (10) to warn passersby of the presence of the portable signaling device (10).

1 Claim, 11 Drawing Sheets

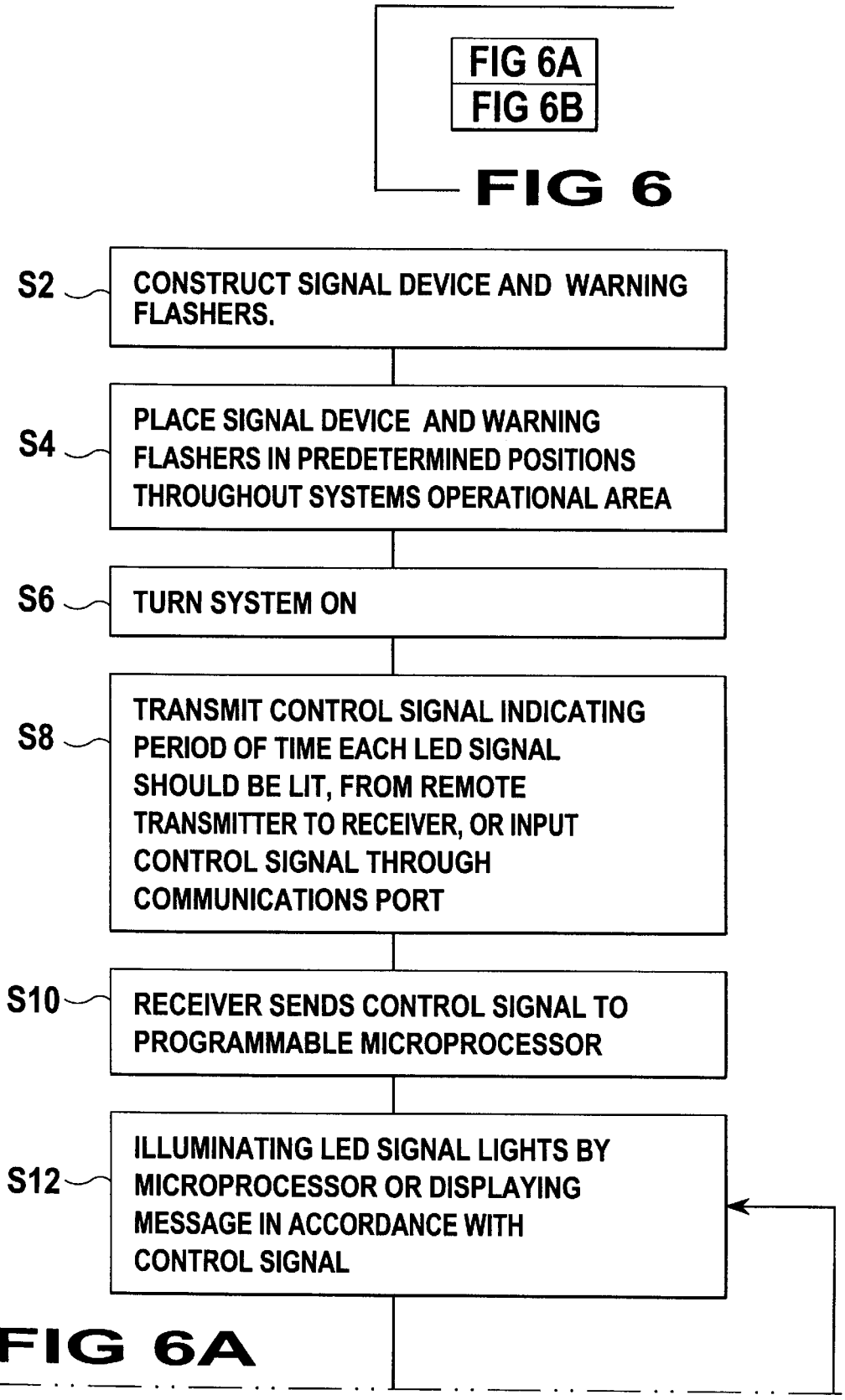
FIG 6A
FIG 6B
FIG 6
S2
CONSTRUCT SIGNAL DEVICE AND WARNING FLASHERS.
S4
PLACE SIGNAL DEVICE AND WARNING FLASHERS IN PREDETERMINED POSITIONS THROUGHOUT SYSTEMS OPERATIONAL AREA
S6
TURN SYSTEM ON
S8
TRANSMIT CONTROL SIGNAL INDICATING PERIOD OF TIME EACH LED SIGNAL SHOULD BE LIT, FROM REMOTE TRANSMITTER TO RECEIVER, OR INPUT CONTROL SIGNAL THROUGH COMMUNICATIONS PORT
S10
RECEIVER SENDS CONTROL SIGNAL TO PROGRAMMABLE MICROPROCESSOR
S12
ILLUMINATING LED SIGNAL LIGHTS BY MICROPROCESSOR OR DISPLAYING MESSAGE IN ACCORDANCE WITH CONTROL SIGNAL
FIG 6A

REMOTE CONTROL PORTABLE TRAFFIC CONTROL DEVICE AND SYSTEM

BACKGROUND OF THE INVENTION

1. Field of the Invention

The instant invention relates generally to remote signaling devices and, more specifically, to a remote control portable traffic signaling device and system for controlling a flow of traffic.

2. Description of the Prior Art

Numerous portable signaling devices have been provided in the prior art. For example, U.S. Pat. Nos. 2,829,362; 2,941,185; 5,252,969; 5,294,138; 5,400,019 and 5,493,292 all are illustrative of such prior art. While these units may be suitable for the particular purpose to which they address, they would not be as suitable for the purposes of the present invention as heretofore described.

U.S. Pat. No. 2,829,362

Inventor: Frank Terrill

Issued: Apr. 1, 1958

This invention relates to a traffic control system and, more particularly, to a system that can be employed to control the movement of traffic in an emergency condition that is not considered normal or permanent.

U.S. Pat. No. 2,941,185

Inventor: Wilbur J. Mullikin

Issued: Jun. 14, 1960

This invention relates to a signal for use at traffic intersections and adapted for easy transport from one location to another particularly for use around schools during opening and closing of the school and at special events requiring traffic control.

U.S. Pat. No. 5,252,969

Inventor: Mitsuhiro Kishi

Issued: Oct. 12, 1993

A temporary signal system wherein a pair of signal stands are installed at spaced locations adjacent a traffic restriction area. Each stand has at least red and green lights which light or flash for a predetermined time period to control vehicle traffic passing the restriction area. The signal stands include timers for counting actual time and providing the actual time, controllers for producing a flashing control signal for a selected red or green light upon reception of a time signal provided by the timer when the controller is in a flashing operation condition, and a lighting driver for permitting the selected red or green light to flash upon reception of the flashing control signal from the controller. The stands have an operation starting arrangement for initiating operation of the controllers of both of the stands at the same time, or a signal transmission arrangement for transmitting the operating condition data between the stands so that the lights of both stands are operated in a controlled and synchronized relationship with each other.

U.S. Pat. No. 5,294,138

Inventor: Nan S. Yang

Issued: Mar. 15, 1994

A traffic control cart includes a rolling wheel assembly, a base fixed on the rolling wheels, a column mounted on the base, an arm pivotally secured on one periphery wall of the column, a light device including at least a green light, a yellow light, and a red light being mounted on a top face of the column. The arm is allowed to reciprocate in a ninety-degree range from vertical position to horizontal position, in the meanwhile one color of the traffic lights is "on" thus controlling the traffic therearound.

U.S. Pat. No. 5,400,019

Inventor: Alfonso J. Riscoe, Jr.

Issued: Mar. 21, 1995

A portable traffic control device for temporary use capable of both automatic and manual operation which portable control device can be raised or lowered by hand and having a horizontal boom which folds down to a vertical position and with an adjustable and collapsible tripod stand and an electrical control circuit.

U.S. Pat. No. 5,493,292

Inventor: Bentley M. Fanslow et al.

Issued: Feb. 20, 1996

A traffic control signal particularly adapted for alternate one-way traffic situations such as are frequently encountered in highway construction zones whereby "STOP" AND "SLOW" sign panels can be alternately displayed with suitable control mechanism which produces a combination rotational and axial displacement of a signal panel whereby one traffic control message can be superimposed upon another for displaying either a "STOP" message or a "SLOW" for the vehicular traffic.

SUMMARY OF THE PRESENT INVENTION

The present invention relates generally to signaling devices and, more specifically, to a remotely or automatically controlled portable traffic signaling device and system for controlling a flow of traffic.

A primary object of the present invention is to provide an ultra portable signaling device and system that will overcome the shortcomings of prior art devices.

Another object of the present invention is to provide an ultra portable signaling device and system which is able to be controlled from a remote location.

A further object of the present invention is to provide an ultra portable signaling device and system which is 100% solid state construction and highly reliable.

A further object of the present invention is to provide an ultra portable signaling device and system which includes no moving parts.

An additional object of the present invention is to provide an ultra portable signaling device and system which includes a removable signal head for changing the identity and configuration of the signal head and thus the information and instructions communicated by the device.

A further object of the present invention is to provide an ultra portable signaling device and system which includes highly reliable power managed LED signal lamp banks which consume a minimal amount of energy during operation.

A yet further object of the present invention is to provide an ultra portable signaling device which is height adjustable or configuarable.

A still further object of the present invention is to provide an ultra portable signaling device and system including a base unit able to store at least one power source and thereby provide the device with an extended period of use.

An even further object of the present invention is to provide an ultra portable signaling device and system wherein the base unit aids in balancing the device and also includes a storage compartment for storing equipment, alternative signaling devices and spare parts for use with the device.

A yet further object of the present invention is to provide an ultra portable signaling device and system including a conflict monitor to monitor the device to prevent an error signal being communicated, e.g. a green light being displayed in opposing directions.

Another object of the present invention is to provide an ultra portable signaling device and system which may be easily and speedily deployed in a desired service area.

Another object of the present invention is to provide an ultra portable signaling device and system that is simple and easy to use.

A still further object of the present invention is to provide an ultra portable signaling device and system that is economical in cost to manufacture and maintain.

Additional objects of the present invention will appear as the description proceeds.

A remote control portable traffic signaling device and system for controlling a flow of traffic is disclosed by the present invention. The remote control portable traffic signaling system includes the portable signaling device and a plurality of oncoming warning flashers. The portable signaling device includes a wireless remote control unit and a signal head having LED signal lamp banks and a programmable microprocessor/controller. The remote control unit transmits a control signal to be received and analyzed by the microprocessor for use in controlling a message communicated by the display device. A base unit including a storage compartment for housing a power source is removably connected to the signal head for supplying power to the microprocessor and display device via a connection wire extending through a pole positioned therebetween. The power source may function as a universal power station able to supply at least one of AC and DC power. The power source may be a battery unit or even a motor generator. A connection device adjustably connects the pole between the signal head and base unit so as to allow for height adjustment of the portable signaling device. Thus the signal head and base are removably connected to one another. The plurality of warning flashers including a pair of high luminous LEDs are positioned at a predetermined distance from the portable signaling device to warn passersby of the presence of the portable signaling device.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
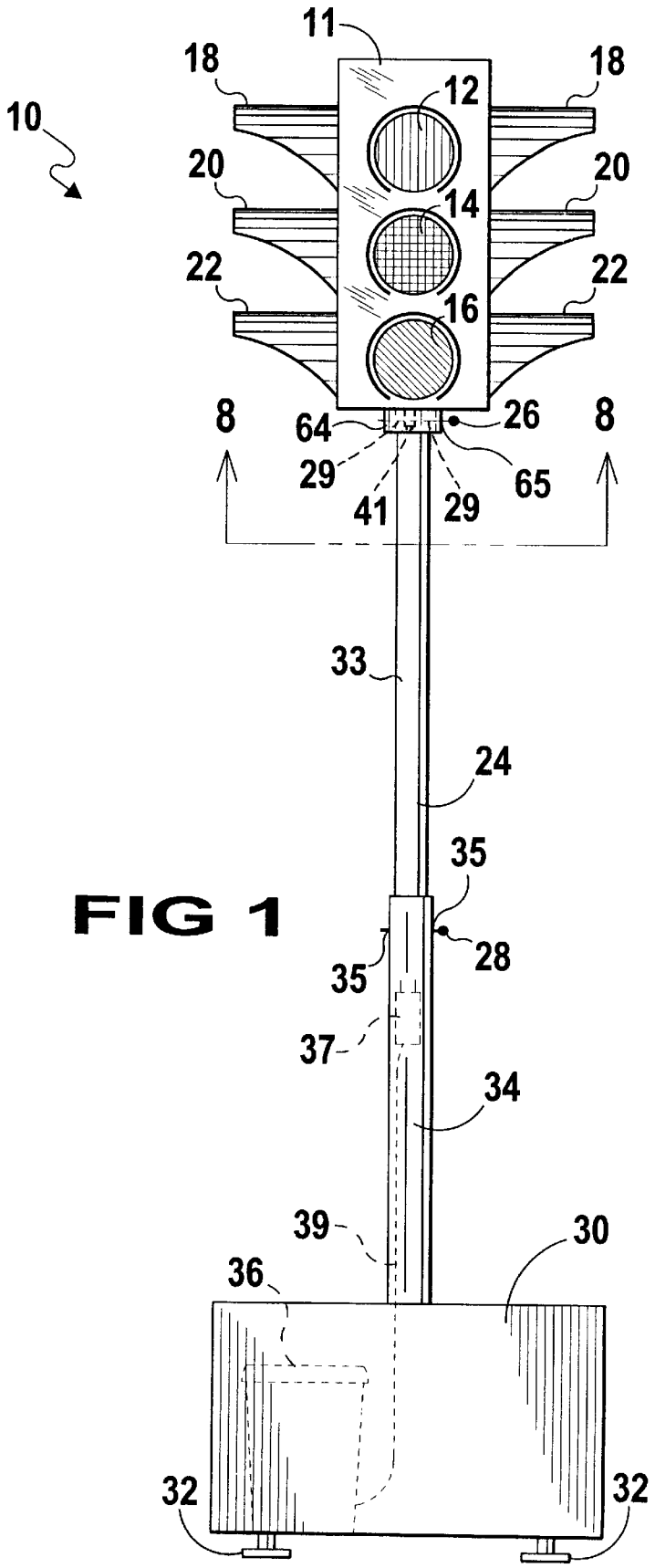
FIG. 1 is a front perspective view of a first embodiment of the remote control portable traffic signal for use with the system of the present invention.

Turning now descriptively to the drawings, in which similar reference characters denote similar elements throughout the several views, the Figures illustrate a remote control portable signaling device and system of the present invention. With regard to the reference numerals used, the following numbering is used throughout the various drawing figures.

10 remote control portable traffic signal device for use with the system of the present invention
11 signal lamp head
12 red light
14 yellow light
16 green light
18 visor for red light
20 visor for yellow light
22 visor for green light
24 removable pole/main mast
26 first connector pin including locking nub
27 height adjustable pole including recesses
28 second connector pin including locking nub
29 pair of recesses
30 base
32 leveling feet
33 reflective sheeting
34 pole receiving device
35 recesses in pole receiving device
36 power source
37 universal power connector block within pole receiving device

38 wire cable connector
39 wire cable connecting power connector within pole receiving device to power source
40 storage compartment/additional battery storage
41 power connector within signal head
42 remote control transmitter unit
44 receiver
46 programmable microprocessor
47 GPS automatic location programming
50 LED signal lamp banks
52 conflict monitor
54 communication port
55 video camera
56 memory
57 theft signal beakon
58 future/additional options "piggy back" port
59 motion sensor
60 flasher/emergency oscillator
61 transmitter to other devices in area
62 LED for illuminating base unit
63 light sensors
64 collar for attachment of pole
65 recesses in connection collar
66 power source for remote control unit
68 microprocessor/logic circuit for remote control unit
70 light select input key
71 options port connector
72 numerical keypad
73 display device on remote control
74 remote control transmitter
76 warning signal indicating portable signal device is being approached
78 barricade warning flasher
80 replacement bulb assembly for use in barricade warning flasher
82 LEDs
84 clear tube housing LEDs
86 flasher circuit
88 plug for connection to bulb socket of stand
90 bulb socket receiving recess
92 stand for warning flasher
94 signaling system

DETAILED DESCRIPTION OF THE PREFERRED EMBODIMENT

Turning now descriptively to the drawings, in which similar reference characters denote similar elements throughout the several views, FIGS. 1 through 10 illustrate a remote control portable signaling device indicated generally by the numeral 10 for use in a signaling system indicated generally by the numeral 94.

Figure 7:
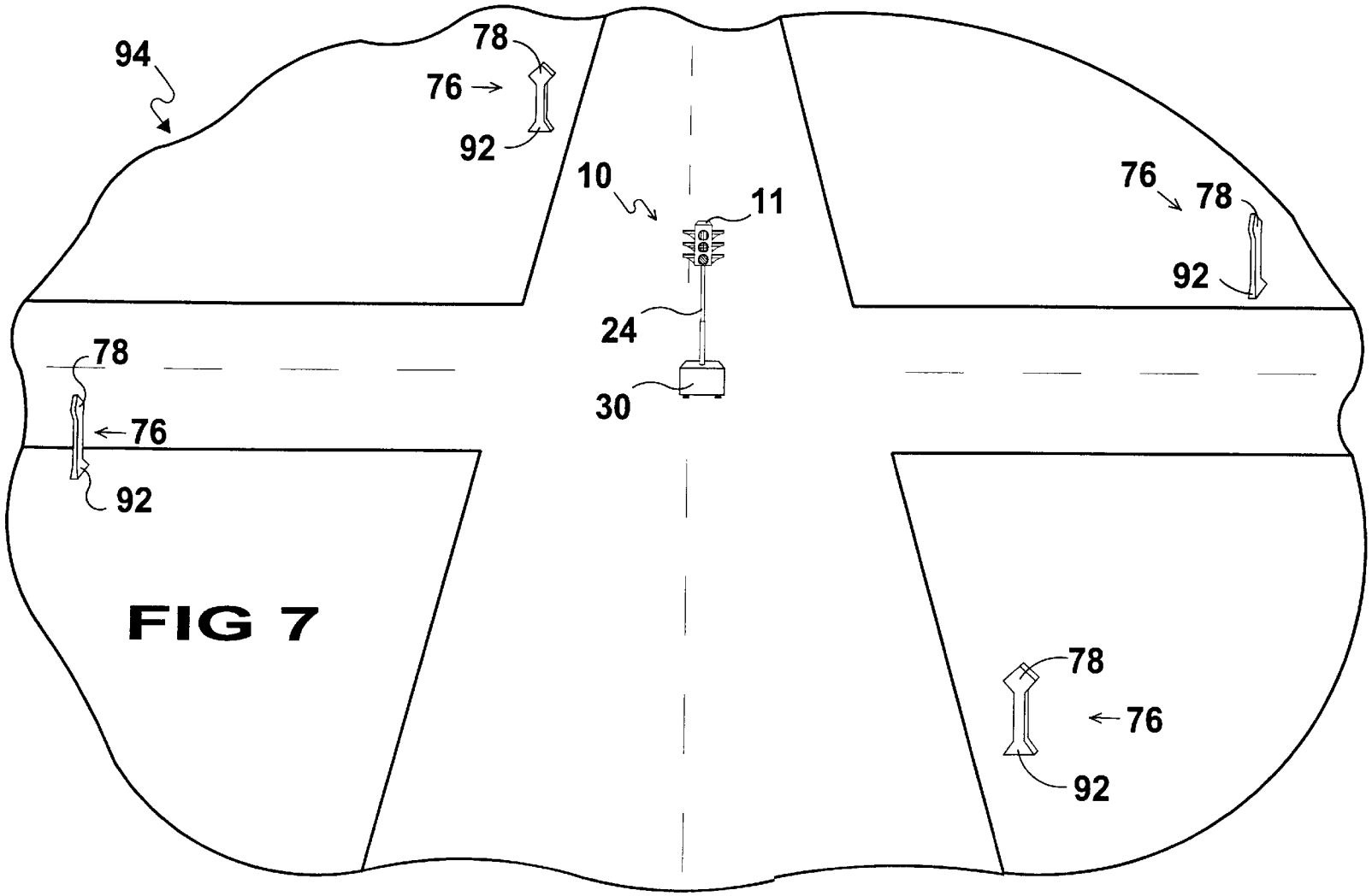
FIG. 7 is a perspective view of the remote control portable traffic signaling system of the present invention.

The remote control portable signaling system 94 includes the portable signaling device 10 and a plurality of warning flashers 76 positioned a predetermined distance from the portable signal device 10. The warning flashers 76 provide an early warning system for indicating the presence of and proximity of passersby to the portable signaling device 10 as is illustrated in FIG. 7. The warning flashers 76 may also alert passersby to the changing of the state of the portable signaling device 10, e.g. from a green light to a red light.

Figure 2:
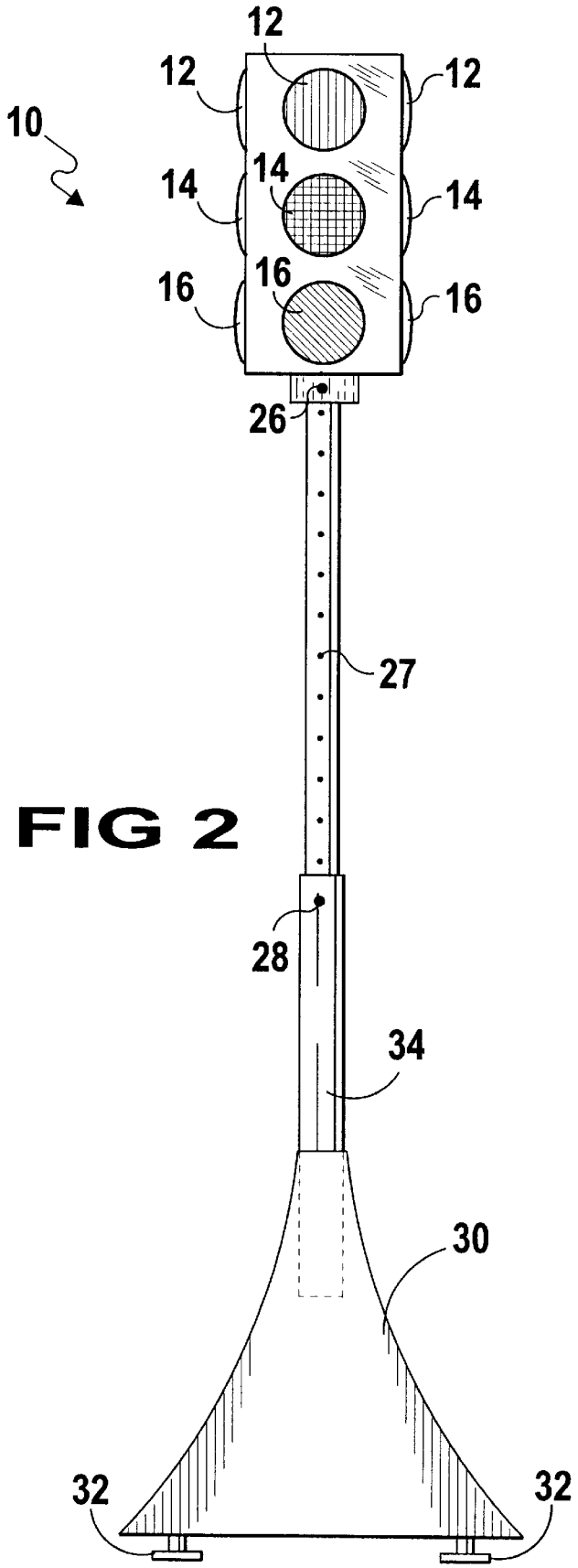
FIG. 2 is a front perspective view of the remote control portable traffic signal without light visors and including an alternatively shaped base unit for use with the system of the present invention.

Each portable signaling device 10 includes a signal head 11 and a base unit 30 connected together by either a removable pole 24 as shown in FIG. 1 or a height adjustable pole 27 as shown in FIG. 2. The removable and adjustable poles 24 and 27 both include reflective sheeting thereon to improve visibility at night. The signal head 11 includes at least one side having a red light 12, a yellow light 14 and a green light 16 positioned thereon so as to be visible when illuminated. The red, yellow and green lights 12, 14 and 16 are indicative of the lights on a commonly known traffic signal. The signal head 11 may also include additional lights such as green and yellow arrows for indicating turning signals. In order to signal vehicles on other sides of the portable signal device 10 additional red, yellow and green lights 12,14 and 16 may be positioned so as to be viewable by vehicles approaching the portable signal device 10 from any desired direction. Shields 18, 20 and 22 are also positioned about each light to shade the respective light from bright sunlight or to direct the light and thereby provide more intense illumination.

A connection collar 64 is positioned below the signal head 11 for removably and adjustably connecting the signal head 11 to either the removable or height adjustable pole 24 or 27. The connection collar 64 is hollow and shaped to receive the pole 24 therein. A recess 65 is positioned on either side of the connection collar 64 for receiving a first securing pin 26 therethrough and connecting the pole 24 thereto. The collar also includes a universal power connector 41 for connecting with a power source located in the base 30 through either the removable or height adjustable pole 24 or 27.

Figure 8:
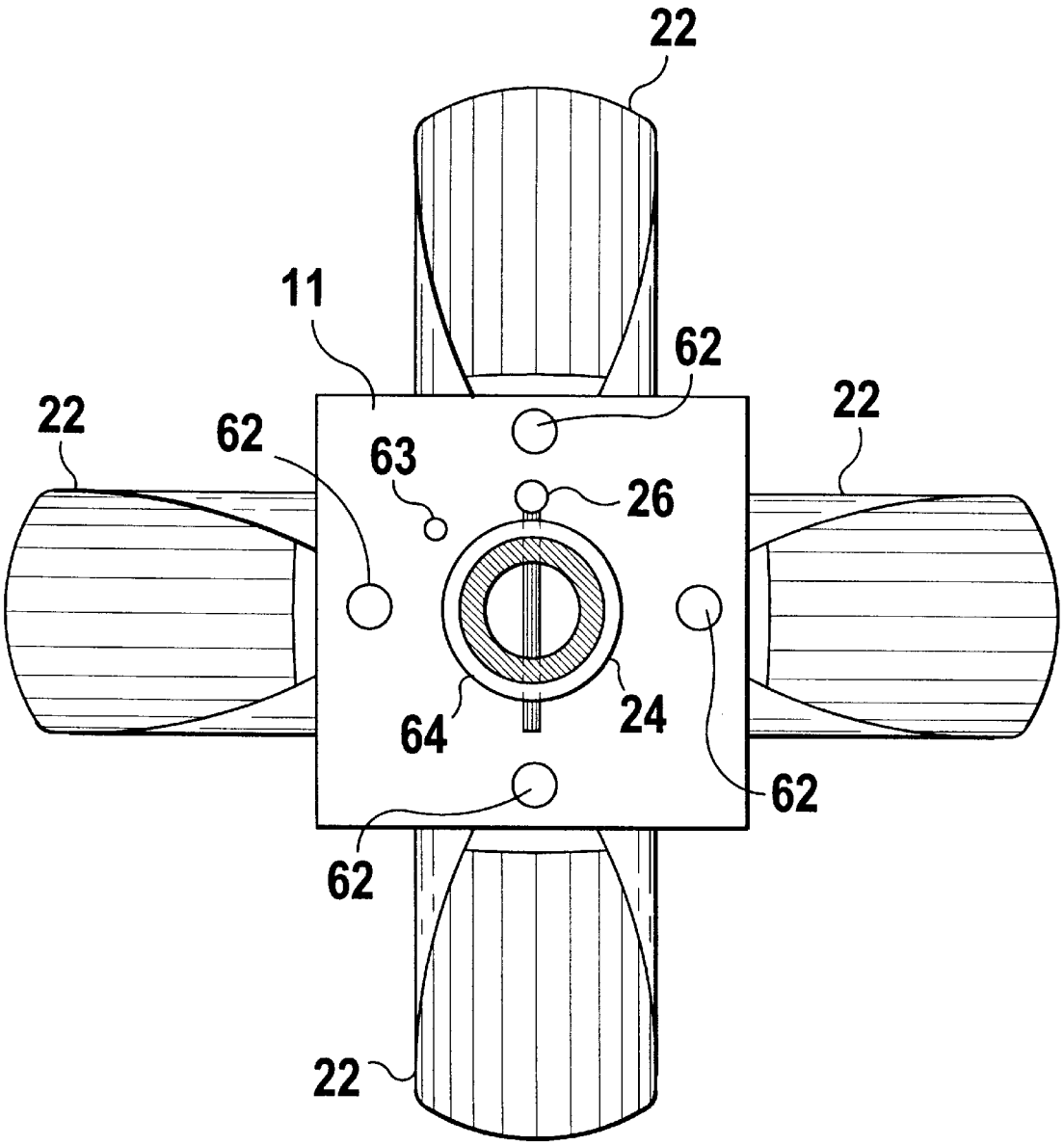
FIG. 8 is a bottom view of the signal head taken along the line 8—8 in FIG. 1.

An underside of the signal head 11 is illustrated in FIG. 8. As is illustrated in this figure, a plurality of LEDs 62 are positioned on an underside of the signal head 11 to thereby illuminate the base unit 30 and thus make the signaling device 10 more visible during periods of decreased visibility and darkness. The illuminating LEDs 62 may include light sensors 63 and thus only illuminate the base unit 30 when certain light deficient situations exist, e.g. at night or during a rain storm. The depiction of four LEDs 62 is for purposes of illustration only and not meant to limit the invention in any manner as to the number of LEDs which may be used to illuminate the base unit 30, the number of LEDs being a design choice of the individual user and not affecting the operation of the system 94 in any manner. Light sensor 63 can also generate a signal for transmission to the programmable microprocessor 46 which will be interpreted to control the output or brightness of the LED lamp banks 50.

It is to be understood that the present invention is not limited to use of the signal head 11 as described above. Any type of signal head such as a stop sign, a caution sign, a blinking red or yellow light, a message board, a speaker system for producing an audio or radio signal, etc. may be connected to the pole 24 using an appropriate connection collar 64. Thus, the portable signal device 10 is able to communicate any desired message to passersby and is not limited to displaying the information communicated by the above described signal head. While numerous mechanisms for communicating a signal have been listed above, and a preferred mechanism for communicating a signal is shown and described herein, those of ordinary skill in the art who have read this description will appreciate that there are numerous other mechanisms for communicating a signal and, therefore, as used herein the phrase "signaling means for communicating a signal" should be construed as including all such mechanisms as long as they achieve the desired result of communicating a signal, and, therefore, that all such alternative mechanisms are to be considered as equivalent to the one described herein.

Connected at the opposing side of either the removable or height adjustable pole 24 or 27 is the base unit 30. The base unit 30 includes leveling feet 32 positioned at a side opposite the connection with the pole 24 for maintaining the portable signal device 10 in an upright position. In lieu of the feet 32, lockable wheels may be positioned on an underside of the base unit 30 providing the device 10 with easy mobility by simply rolling the device 10 into the proper position. A pole receiving device 34 is positioned to extend from the base unit 30 and receive either the removable or height adjustable pole 24 or 27 therein. The pole receiving device 34 includes a recess 35 positioned on either side thereof for receiving a second securing pin 28 and adjustably securing either the removable or height adjustable pole 24 or 27 within the pole receiving device 34. The pole receiving device 34 is of a length able to receive a substantial portion of the height adjustable pole 24 or 27 therein and thus allow for height adjustment and stability of the portable signal device 10. The pole receiving device 34 also includes a universal power connector block 37 to provide a connection between the power source located in the base 30 and either the removable or height adjustable pole 24 or 27 via a connection cable 39 for ultimately providing power to the signal head 11.

The height adjustable pole 27 includes a plurality of aligned recess pairs along the length thereof and a pair of recesses 29 at a top side thereof. The pair of recesses 29 at the top side are aligned with the recesses 65 in the connection collar 64 of the signal head 11 for placement of the first connecting pin 26 therethrough and connection of the pole 24 to the signal head 11. The opposing end of the height adjustable pole 27 is positioned within the pole receiving device 34 to a desired depth wherein the signal head 11 extends to a desired height above the ground and a pair of the plurality of aligned recesses 29 corresponding to the desired height are aligned with the recesses 35 in the pole receiving device 34. The second connecting pin 28 is inserted to extend through the pair of aligned recesses 29 in the height adjustable pole 27 and the recesses 35 in the pole receiving device 34 for adjustably connecting the base unit 30 to the height adjustable pole 27. Alternatively a plurality of fixed length poles 24 may be removably connected between the base 30 and signal head 11 for maintaining a fixed height for the device 10.

While a preferred structure for adjustably connecting the pole 24 between the signal head 11 and base unit 30 is shown and described herein, those of ordinary skill in the art who have read this description will appreciate that there are numerous other structures for connecting the pole 24 between the signal head 11 and base unit 30 and, therefore, the phrase "means for connecting the pole 24 between the signal head 11 and base unit 30" should be construed as including all such structures as long as they achieve the desired result of adjustably connecting the pole 24 between the signal head 11 and base unit 30, and therefore, that all such alternative mechanisms are to be considered as equivalent to the one described herein.

Figure 3:
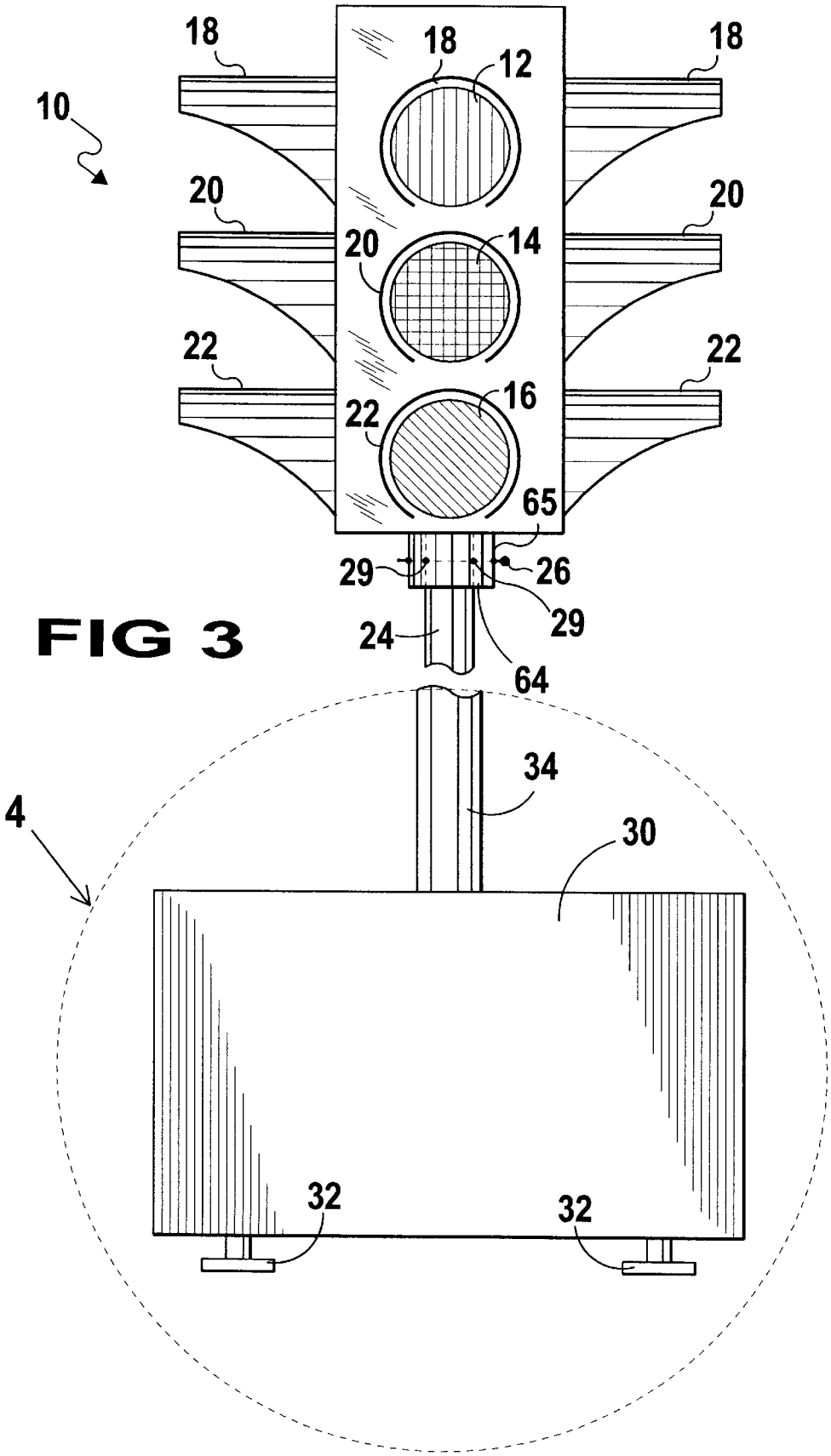
FIG. 3 is an enlarged front view of the remote control portable traffic signal for use with the system of the present invention.
Figure 4:
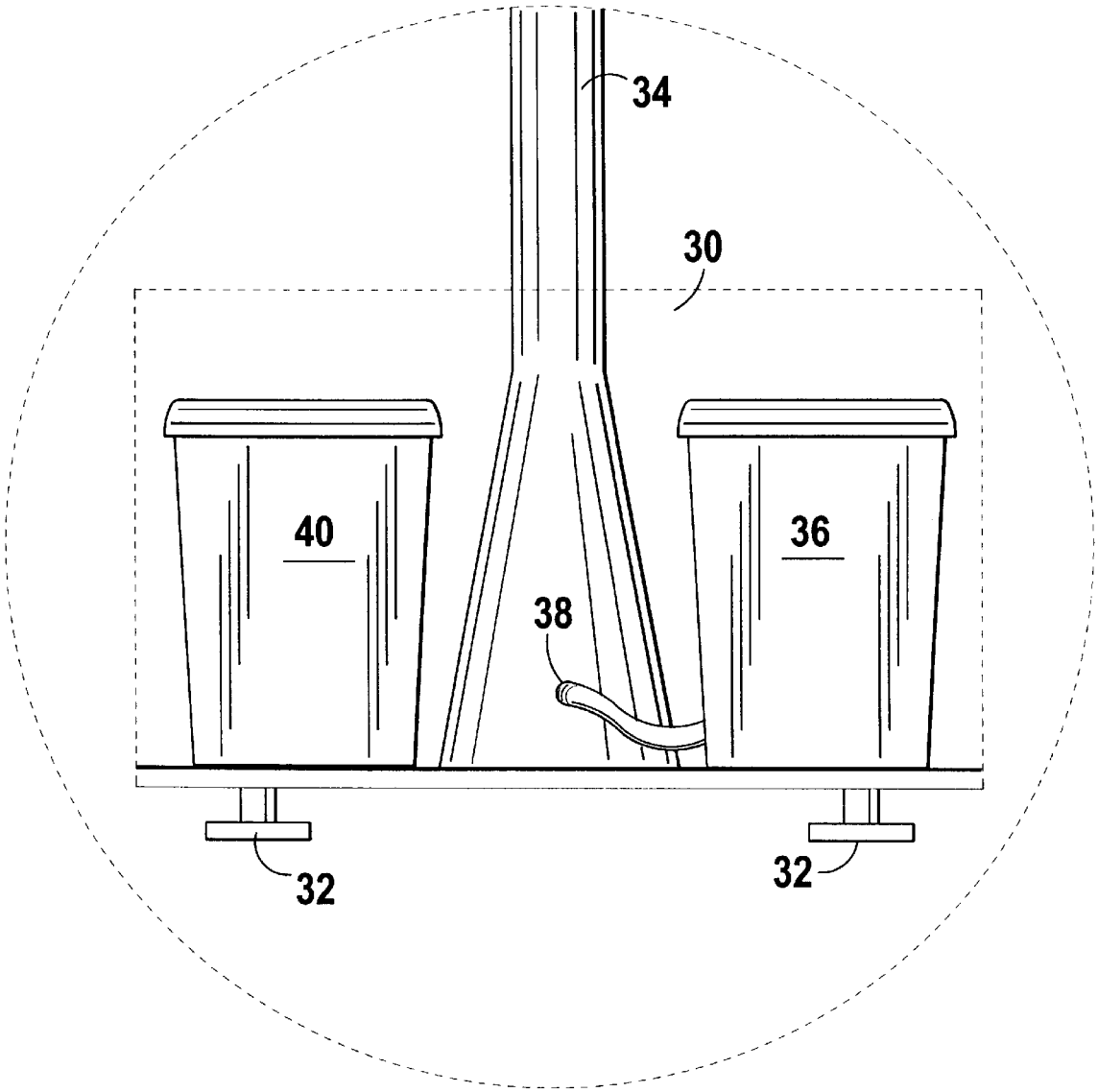
FIG. 4 is an enlarged view of the inside of the base unit of the remote control portable traffic signal for use with the system of the present invention.

FIGS. 3 and 4 depict the base unit 30 in more detail. FIG. 4 illustrates the internal components of the base unit 30 which includes an area for placement of an internal power source 36. The internal power source 36 is connected to the signal head 11 via a connection wire 38 extending from the power source 36 through the pole receiving device 34 and the pole 24. A storage area 40 for tools and alternative signaling devices and parts for the signaling device 10 is also located within the base unit 30. The positioning of the storage area 40 and the power source 36 in FIG. 4 is for purposes of example only and not meant to limit the invention in any manner. Furthermore, the portable signaling device 10 may include more than one internal power source 36 for supplying additional power to the signal head 11 and thus increase its operating life without recharging the power source 36. The shape of the base unit 30 may be in the form of a box as depicted in FIG. 1 or pyramidal as depicted in FIG. 2. The actual shape of the base unit 30 is not critical as long as the base unit 30 is able to provide a storage area for an internal power supply 36 and any tools or replacement parts deemed necessary while being able to adjustably secure the pole 24 in an upright position.

Figure 5:
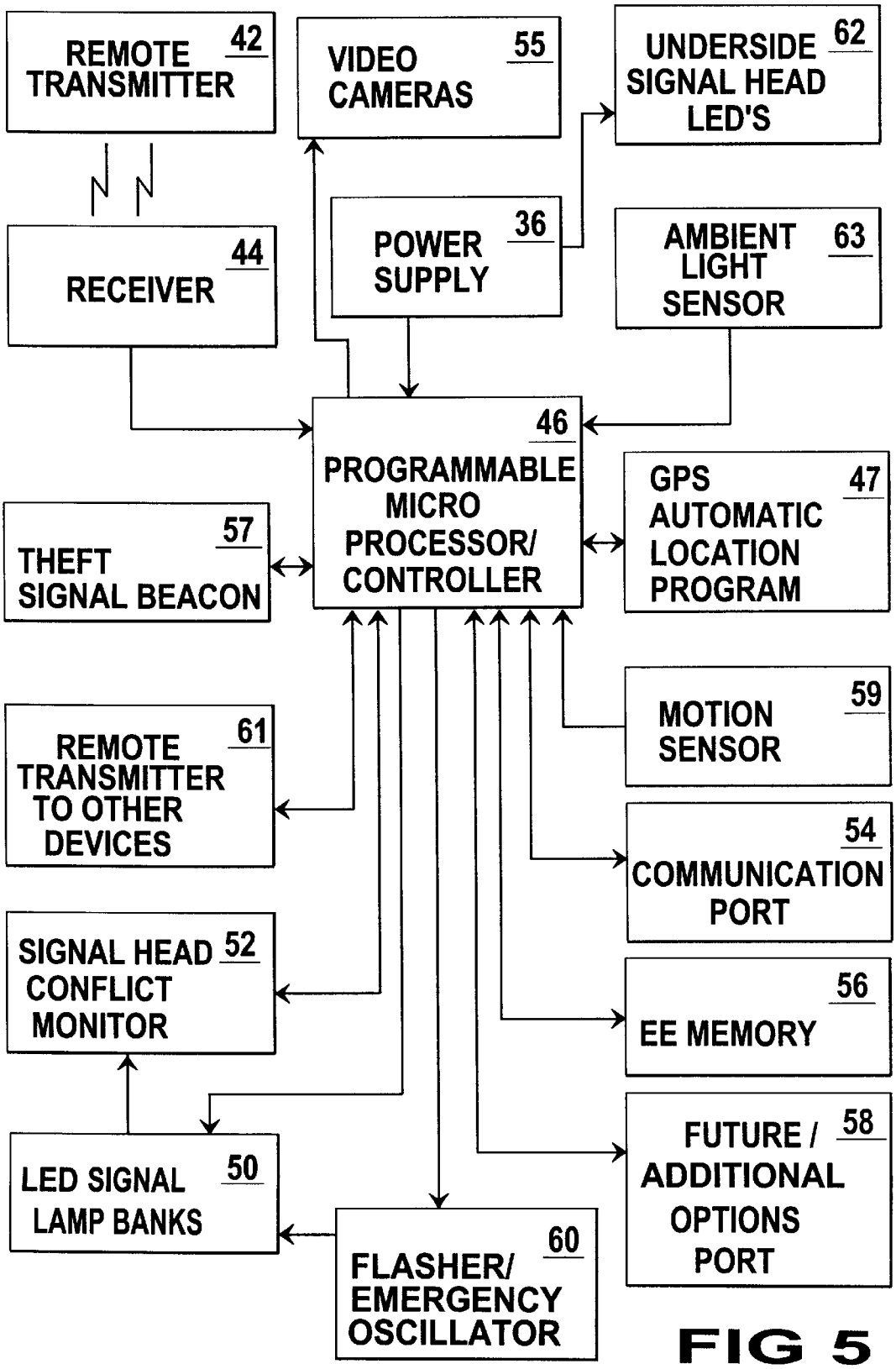
FIG. 5 is a block diagram illustrating the internal components of the remote control portable traffic signal of the present invention.

The internal components of the signal head 11 are depicted in FIG. 5. The internal power source 36 is positioned within the base unit 30 and includes an extension wire 38 which extends through the pole 24 and provides an electrical connection to a programmable microprocessor/controller 46. The programmable microprocessor/controller 46 is connected to a receiver 44 which receives signals transmitted by a user via a remote transmitter 42 or through the communication port 54 or 58. The remote transmitter 42 will be described in more detail with specific reference to FIG. 9. The instructional data received by the programmable microprocessor/controller 46 via the receiver 44 or the communication port 54 is either stored in a memory 56 or used to control operation of the signaling device 10. The programmable microprocessor/controller 46 is connected to illuminate the LED signal lamps 50, i.e. the red, yellow and green lights, based upon the instruction data received by the programmable microprocessor/controller 46. Also connected to the programmable microprocessor/controller 46 is a GPS automatic location programmer 47 for adjusting the timing controlled by the programmable microprocessor/controller 46 based upon the location in which the system is placed.

The LEDs 62 on the underside of the signal head 11 are also directly connected to the power source 36. The light sensor device 63 which senses the amount of light in the environment in which the signal device 10 is operating is connected to the programmable microprocessor/controller 46. The light sensor 63 generates a signal for transmission to the programmable microprocessor 46 which will be interpreted to control the output or brightness of the LED lamp banks 50. Based upon the amount of light sensed by the light sensor device 63, the programmable microprocessor/controller 46 provides power from the power supply 36 to the LEDs 62 when certain predetermined light deficiency requirements are met.

A conflict monitor 52 is connected between the LED signal lamps 50 and the programmable microprocessor/controller 46 for monitoring the signals being communicated by the LED signal lamps 50, i.e. the lighting sequence of the LED signal lamps 50. The conflict monitor 52 determines if the illumination of the LED signal lamps 50 is in error, e.g. if a green light is lit in opposing directions, and communicates such to the programmable microprocessor/controller 46. In response to receipt of an error signal the microprocessor/controller 46 causes either the illumination of the LED signal lamps 50 to cease or initiates a safety situation such as a flashing red light, i.e. a stop signal, or turns the system off. Connected between the programmable microprocessor/controller 46 and the LED signal lamps 50 is a flasher/emergency oscillator circuit 60 for producing a flashing effect whereby the LED signal lamps will flash on and off. The flasher/emergency oscillator circuit 60 is controlled by the microprocessor/controller 46 based upon the instruction data transmitted to the programmable microprocessor/controller 46 and stored in the memory 56 or it may be activated upon determining by the conflict monitor 52 that the LED signal lamp banks are lit in error.

A future additions/options port 58 is also connected to the programmable microprocessor/controller 46 for connection of peripheral devices such as an audio signal device for producing an audio or radio warning signal or a message board for displaying a warning message in addition to the message already communicated by the signal head 11. The future additions/options port 58 may also be used to program the microprocessor/controller 46 instead of through the use of the remote control unit 42. An additional options port 58 is also connected to the programmable microprocessor/controller 46 for connection of any additional peripheral devices or for use in programming of the programmable microprocessor/controller 46 or changing the interval times at which the programmable microprocessor/controller 46 illuminates the LEDs of the signal head.

Other components such as a video camera 55, theft signal beacon 57, a motion sensor 59 and a transmitter 61 for alerting other devices within the system as to current conditions are also connected to the programmable microprocessor/controller 46. The video camera 55 is connected to the power supply for recording on video tape all occurrences which occur in the area surrounding the signaling device 11. The video camera 55 operates as a conventional video camera and video tapes all occurrences surrounding the device when connected to the power supply. An individual video camera 55 can be positioned on all sides of the device to record all occurrences surrounding the device. The theft signal beacon 57 is connected to the programmable microprocessor/controller 46 for transmitting a theft signal when the signal head is removed from the device by an unauthorized party. The theft signal beacon operates as a conventional radio signal transmitter. A motion sensor 59 is also connected to the programmable microprocessor/controller 46 for sensing the flow of traffic and any moving objects around the device. The programmable microprocessor/controller 46 can then adjust the signaling of the device to best accommodate the flow of traffic surrounding the device. When the programmable microprocessor/controller 46 changes the programmed signaling of the device or simply changes signals in accordance with its programming it is able to alert other signaling devices within the system area as to the changes. The other signaling devices can then adjust their signaling patterns to correlate with the other devices in the system and thereby increase the flow of traffic.

Figure 9:
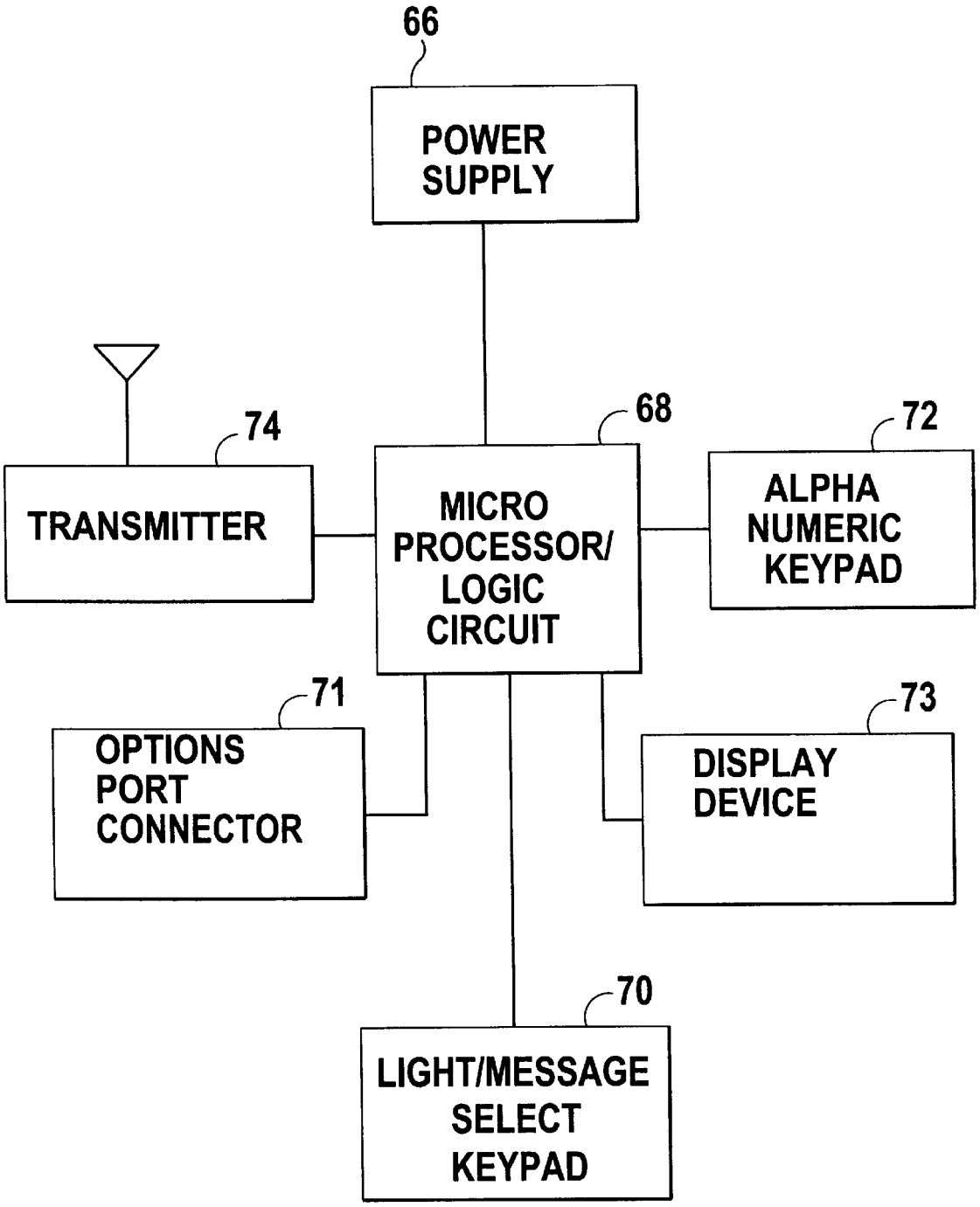
FIG. 9 is a block diagram illustrating the components of the remote control unit for use with the portable traffic signal used in the system of the present invention.

The internal components of the remote control unit 42 are illustrated in FIG. 9. The remote control unit 42 includes an internal power source or battery 66 for supplying power to a microprocessor 68. The face of the remote control unit 42 includes a keypad including light/message select keys 70 and alpha-numeric keys 72. The light/message select keys 70 allows the user to select a particular message to be displayed by the signal device or to select a particular one of the LED signal lamps for inputting a control signal. The light/message select keys 70 include a plurality of buttons for entering a predetermined mode for use in programming the programmable microprocessor/controller 46 or for stepping through a programmed menu to select predetermined programming for the programmable microprocessor/controller 46. The alpha-numeric keys 72 are used in conjunction with the light/message select keys 70 to select an LED signal light and to set a duration for which the selected light will remain illuminated, e.g. setting the red light to remain illuminated for 45 seconds, the yellow light to remain illuminated for 5 seconds and the green light to remain illuminated for 35 seconds. The microprocessor 68 receives this information from the light/message select keypad 70 and the alpha-numeric keypad 72 and relays the signals to a transmitter 74 for transmission to the receiver 44 in the signal head 11 of the portable signal device 10. The remote control unit 42 also includes a connections port 71 for connection to the connection port 54 for directly programming the programmable microprocessor/controller 46 and a display device 73 for displaying the programming options to the user as he activates the alpha-numeric keypad 72 and light/message select keypad 70.

Figure 10:
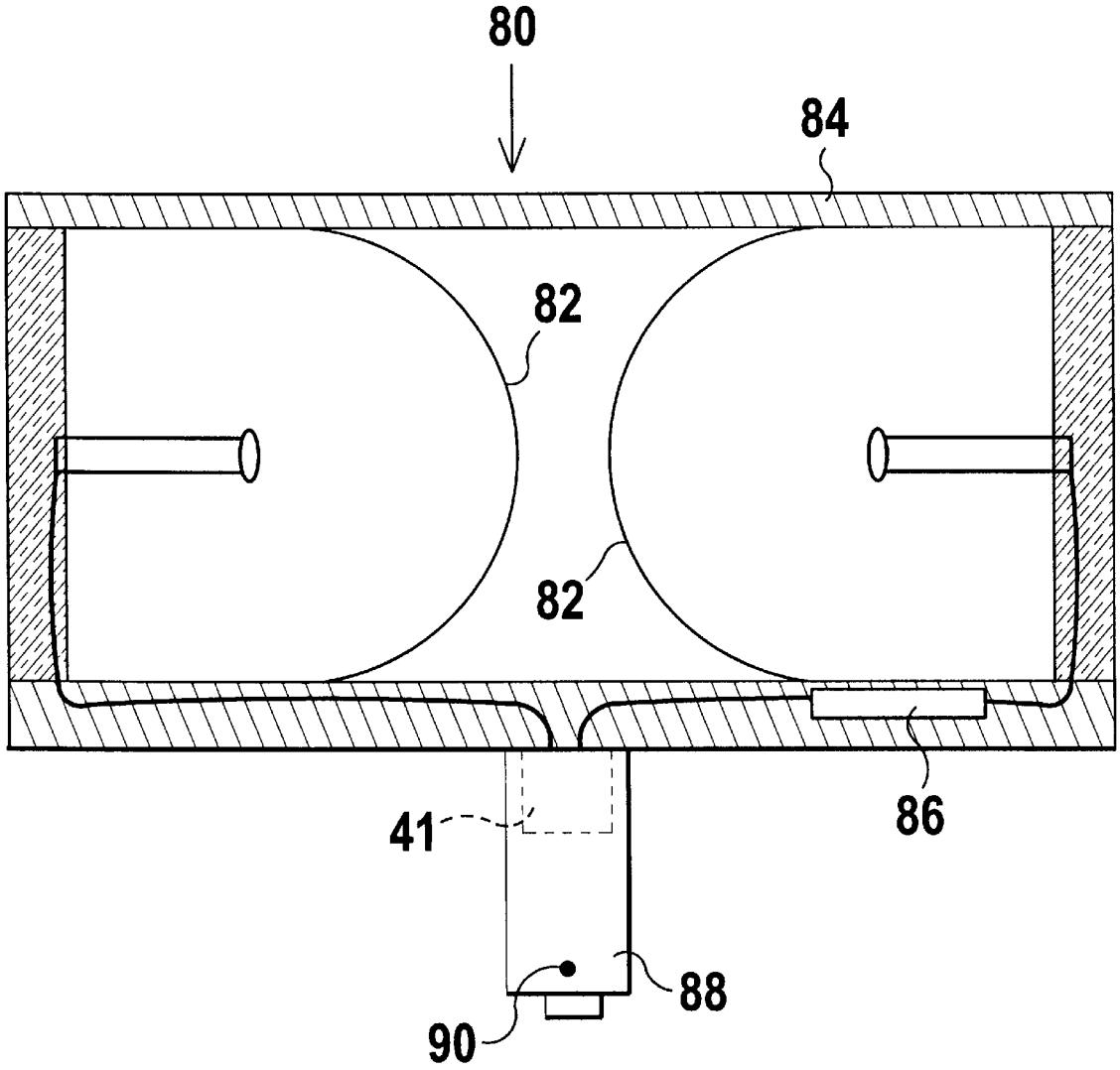
FIG. 10 is a cross-sectional side view of the power management LED warning flasher assembly for use with and providing an early warning system for the remote control portable traffic signaling system of the present invention.

FIG. 10 illustrates an LED barricade warning flasher replacement bulb assembly 80 used with the warning signal device 76. The warning signal devices 76 are positioned prior to encountering the portable signal device 10. The warning flasher 80 includes two LEDs 82 preferably positioned head-to-head within a clear tube 84 although other configurations may be used. It is preferred to use two 10mm High luminous LEDs for producing the most energy efficient warning signal although any LEDs suitable to produce a sufficient amount of light may be used. In this configuration, the LEDs 82 illuminate the tube 84 and direct light towards the opposing side of the tube 84 in which they are placed thus directing light through the transparent LED bodies and out of both sides of the tube 84. A current limit resistor or flasher circuit 86 may be connected to the LEDs 82 causing them to flash on and off. Connected to an underside of the tube 84 is a universal connector device 88 for connecting the warning flasher 80 to any number of different stands and thus placement of the warning flasher 80 in any number of different places and positions. An internal power source may be present within the warning flasher 80 or may be within the stand 92 and connected to the warning flasher 80 via the connection collar 88 for supplying power to illuminate the LEDs 82.

Figure 6B:
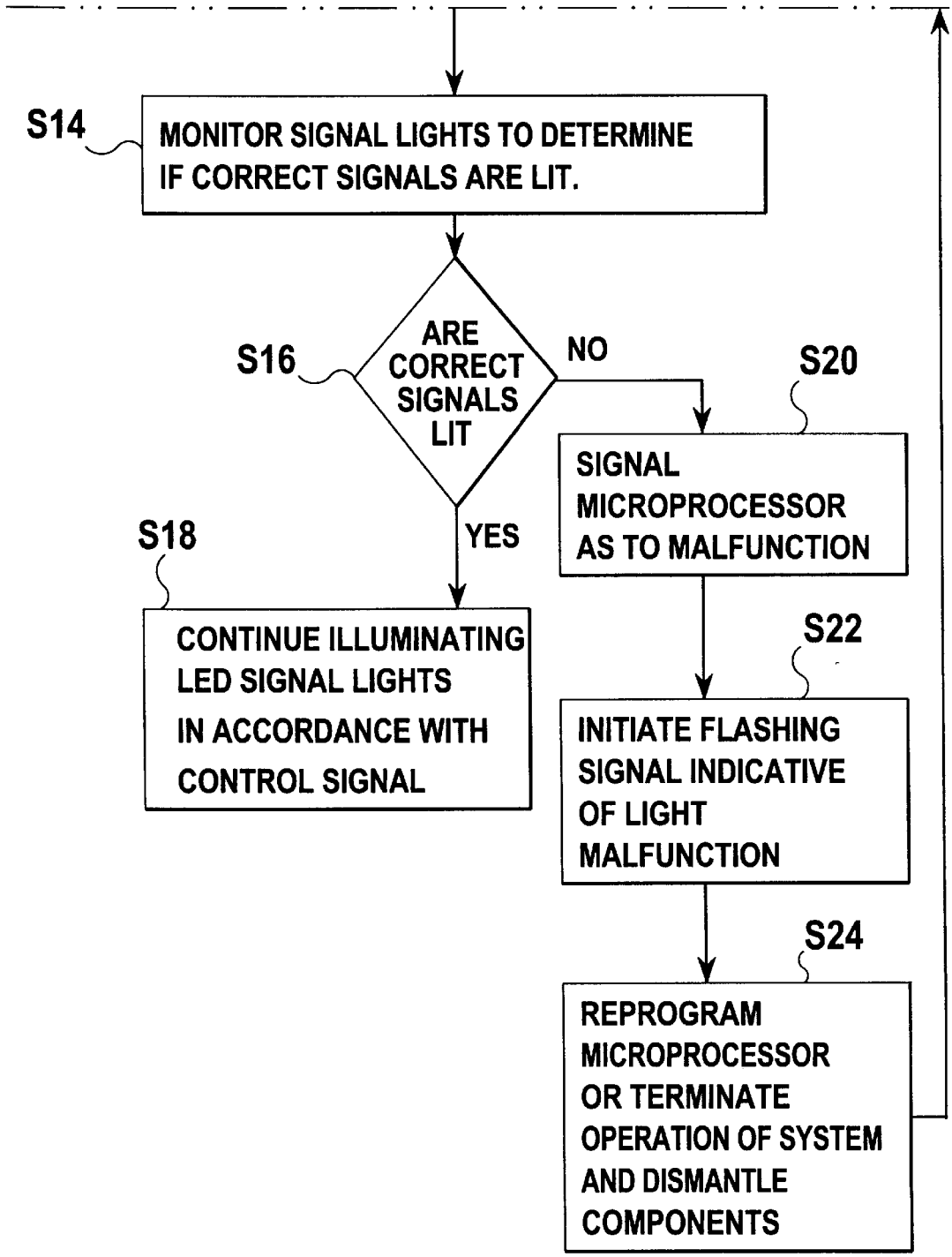
FIG. 6 is a flow chart describing operation of the remote control portable traffic signaling system of the present invention.

The operation of the device and system will now be described with specific reference to FIG. 6. In step S2 the portable signaling device 10 is constructed by connecting the desired signal head 11 and base unit 30 to opposite sides of the pole 24. The height of the signal device 10 is adjusted by controlling the depth to which the pole 24 extends into the pole receiving device 34 of the base unit 30. Alternatively, various fixed length poles can be used to set the portable signaling device at a desired height. The warning flashers 80 are then connected to their respective stands 92 to form the warning signal devices 76. Next the system 94 is set up by positioning the portable signaling device 10 in the middle of the system area and each warning signal device 76 about the area in which the system 94 is to operate as stated in step S4. The portable signaling device 10 is positioned in the center of the area while the warning signal devices 76 are positioned about the area to warn that the portable signaling device 10 is activated and will be encountered shortly. The portable signaling device 10 and each warning signal device 76 is then turned on by supplying power to the appropriate components as described in step S6 thus making the system 94 operational.

The portable signaling device 10 is then programmed to communicate the desired signal either through a transmission from the remote control unit 42 to the receiver 44 in the signal head 11 or through data input to the programmable microprocessor/controller 46 through the communications port 54 or future additions/options port 58 as stated in step S8. If the remote control unit 42 is used, the signals received by the receiver 44 are sent to the programmable microprocessor/controller 46 in step S10. If the signal head 11 includes a plurality of lights, e.g. red, yellow and green as used in a conventional traffic signal, the time periods for operation are programmed into the microprocessor/controller 46. If the signal head 11 is an LED message board the message to be displayed is input to the microprocessor/controller 46 for display on the message board as described in step S12.

As the LED signal lamps 50 are lit according to the programmed time periods, the sequence is constantly checked by the conflict monitor 52 to determine if an error in illuminating the LEDs has occurred, e.g. two LEDs are illuminated at the same time, steps S14 and S16. If it is determined the illumination of the LEDs are correct, the illumination of the LEDs is continued in accordance with the programming of the microprocessor/controller 46 as stated in step S18. If an error in illuminating the LEDs occurs, an error signal indicative of a malfunction is transmitted to the microprocessor/controller 46 and the microprocessor/controller 46 initiates a flashing signal, e.g. a flashing red LED signifying a stop signal to control traffic, indicating an illumination malfunction as described in steps S20 and S22. This signal continues until the microprocessor is reprogrammed or operation of the system is terminated and dismantled in step S24.

From the above description it can be seen that the remote control portable signal device and system of the present invention is able to overcome the shortcomings of prior art devices by providing a remote control portable signal device and system which is able to be controlled from a remote location and includes a removable head piece for changing the signal communicated by the device. The portable signaling device and system is also configured to consume a minimal amount of energy during operation and is height adjustable. A base unit of the device includes a storage compartment for storing equipment and replacement parts for the device and is also able to store a plurality of power sources to thereby provide extended use of the device. Furthermore, the remote control portable signal device and system of the present invention is simple and easy to use and economical in cost to manufacture, operate and maintain.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A remote control portable traffic signaling system including a device connected to a power source for controlling a flow of traffic comprising:

a) remote control means for transmitting a control signal;

b) a signal head including a display means for communicating a message to passersby and a controller for receiving said control signal transmitted by said remote control means and connected to control said message communicated by said display means based upon said received control signal, said display means comprising red LED's facing in multiple directions, yellow LED's facing in multiple directions, and green LED's facing in multiple directions, said red, yellow and green LED's being each illuminated for a length of time indicated by a control signal received from said remote control unit;

c) a base unit including a storage compartment for housing the power source, the power source being connected to supply power to said display means, tools, optical and other replacement parts for use by said portable signal device;

d) a pole positioned between said signal head and base unit;

e) means for adjustably connecting said pole between the signal head and base unit;

f) conflict monitor means in said signal head connected between said controller and said display means for monitoring illumination of said red, yellow and green lights to determine it said illumination is in error and causes said lights to cease operation or initiates a safety situation it the operation of said lights is in error, said controller generating a default error signal upon receipt of an error signal from said conflict monitor;

g) the underside of said signal head having a plurality of downwardly facing LED's illuminating said base unit and light sensors to turn on said downwardly facing LED's when a light deficient situation exists and generate a signal for transmission to said microprocessor to control the brightness of said red, yellow, and green LED's;

h) a plurality of warning flashers positioned about an operating area at a predetermined distance from said portable signaling device for indicating the presence of said portable signaling device controlling a flow or traffic, each of said warning flashers comprising a stand and an LED flashing assembly connected to said stand;

i) said signal head further includes a communication port connected to said controller for attachment of a peripheral device for communicating a second message to passerby, a memory connected to said controller for storing said received control signal for use by said controller in controlling said display device;

j. said display device being controlled by said controller to produce at least one of an audio signal, a radio frequency, and any other communication signal; and k. beacon means for transmitting a theft signal when said signal head is removed from said device by an unauthorized party.

* * * * *